United States Patent [19]

McLear

[11] 4,168,828

[45] Sep. 25, 1979

[54] ARTICLE PROCESSING CONTROL SYSTEM

[75] Inventor: James A. McLear, Belvidere, N.J.

[73] Assignee: Harris Corporation, Cleveland, Ohio

[21] Appl. No.: 863,661

[22] Filed: Dec. 23, 1977

[51] Int. Cl.[2] ..... B65H 39/02

[52] U.S. Cl. ..... 270/54; 270/56; 270/58

[58] Field of Search ..... 270/54–58; 271/172, 256–259

[56] References Cited

U.S. PATENT DOCUMENTS

| | | | |
|---|---|---|---|
| 3,899,165 | 8/1975 | Abram | 270/54 |
| 3,972,521 | 8/1976 | Reed | 270/58 |

*Primary Examiner*—Edgar S. Burr
*Assistant Examiner*—A. Heinz

[57] ABSTRACT

A system for collating and controlling the processing of articles. A collator assembles the articles from a plurality of article portions. The completed articles are deposited onto a conveyor, which transports them to a processing station. The collator is temporarily disabled from beginning the assembly of another group of articles when assembly of the final article of the preceeding group of articles has been initiated. The conveyor thus has a gap thereon, which contains no articles. A signal is generated concurrently with the beginning of the gap, and is delayed by an amount selected so that the delayed signal should occur concurrently with the arrival of the gap at the processing station. The time occurrence of the delayed signal is adjusted in accordance with the actual movement of the gap along the conveyor. The conjunction of the delayed signal with the arrival of the gap causes the processing station to accomplish a selected function. The collator may be a newspaper stuffing machine producing newspapers including different inserts, and the processing station may be such downstream equipment as a stacker, label station, loading dock, etc.

7 Claims, 6 Drawing Figures

ARTICLE PROCESSING CONTROL SYSTEM

BACKGROUND AND FIELD OF THE INVENTION

The present invention relates to a machine for gathering or collating a plurality of articles into different groups, and for controlling the operation of machines located along a conveyor downstream of the gathering machine. The invention will be described with specific reference to a system for handling newspapers produced by a newspaper gathering (stuffing) machine, wherein the stuffing machine produces different assemblages or newspapers which must be handled by downstream equipment.

It has long been recognized that newspapers may serve as a convenient, low cost vehicle for distributing geographically specific advertising. The newspapers destined for a given geographical zone will be collated to include a number of standard sections (or inserts, as they are commonly referred to) which are to be included in the newspapers for all zones, together with one or more sections incorporating advertising specifically tailored to the readers in that zone.

The collators which have been used in the past to assemble newspapers may be used for the production of geographically specific newspapers. If no means is provided for automatically changing over from the assembly of newspapers for one geographical zone to the assembly of newspapers for the next zone, then the collator must be shut down during the changeover. If the zones are reasonably small, this may result in unacceptable loss in operating time. If means are provided for changing over from one zone to the next without interruption, then this downtime is averted.

As the newspapers are produced, they will be dropped from the collator onto a conveyor and will then be carried by the conveyor to downstream newspaper handling equipment. This equipment may include a stacker, tying equipment, labeler, and truck-loading equipment. This downstream equipment must be notified of a changeover by the collator from the production of newspapers for one zone to the next. For example, it is desirable that the stacks of newspapers provided by the stacker should each include newspapers for only a single zone. The stacker must therefore eject the stack being accumulated at the time that the first newspaper of a new zone arrives. Similarly, the labeler must know when newspapers for a new zone have arrived so that appropriately different labels may be applied to the papers in the new zone.

It is known to create gaps in a stream of like newspaper sections being conveyed to a plurality of stuffing machines. This gap maker operates to briefly hold the newspapers at one point in the stream, while permitting previous newspapers to continue along the conveyor. This creates a visible gap between the newspapers along the conveyor; the gap thus generated has been used to control divert gates to the respective stuffing machines.

SUMMARY OF THE INVENTION

The present invention provides a collating system which assembles newspapers or similar items in accordance with geographic zone considerations and control the downstream newspaper handling equipment in accordance with the zone considerations. This is accomplished without stopping the system.

The system includes means for causing the collator to briefly stop assembling newspapers or similar items after assembling those necessary for a given zone, so that a control gap in the stream of newspapers from the collator is provided without use of a gap maker. This gap, which separates newspapers destined for different geographical zones, is then used for control of downstream equipment.

In the specific embodiment which will be described hereinafter, a newspaper collating machine is disclosed which assembles newspapers and deposits them onto a conveyor. The conveyor transports the assembled newspapers through one or more downstream processing machines, such as a stacker, tier, labeller, and automated loading dock. The collator includes several hoppers which each include newspaper sections for a different geographic zone. In assembling the newspapers for any given zone, only selected ones of these hoppers are actuated, the remaining ones being disabled from contributing to the newspapers being assembled. The collator is disabled from assembling additional newspapers for a selected number of machine cycles after assembly of the final newspaper of a given geographic zone has begun. This produces a control gap in the newspapers along the conveyor.

In the specific system described, the collator includes an automatic repair feature which can cause gaps in the newspapers along the conveyor for reasons other than the completion of a geographic zone. However, it is not uncommon for gaps to also occur in non-repair collator systems. Consequently, an electrical signal is generated concurrently with the gap between the geographic zones. This electrical signal is delayed by an amount selected so that the delayed electrical signal arrives at the downstream processing equipment concurrently with the arrival of the zone separation gap. The conjunction of the delayed electrical signal with the arrival of a gap at the downstream processing equipment effect the necessary control of that downstream processing equipment when a change in geographic zones occurs.

BRIEF DESCRIPTION OF THE DRAWINGS

The foregoing and other objects and advantages of the present invention will becomes more readily apparent from the following description of a preferred embodiment, as taken in conjunction with the accompanying drawings which are part hereof and wherein.

DETAILED DESCRIPTION

Figure 1:
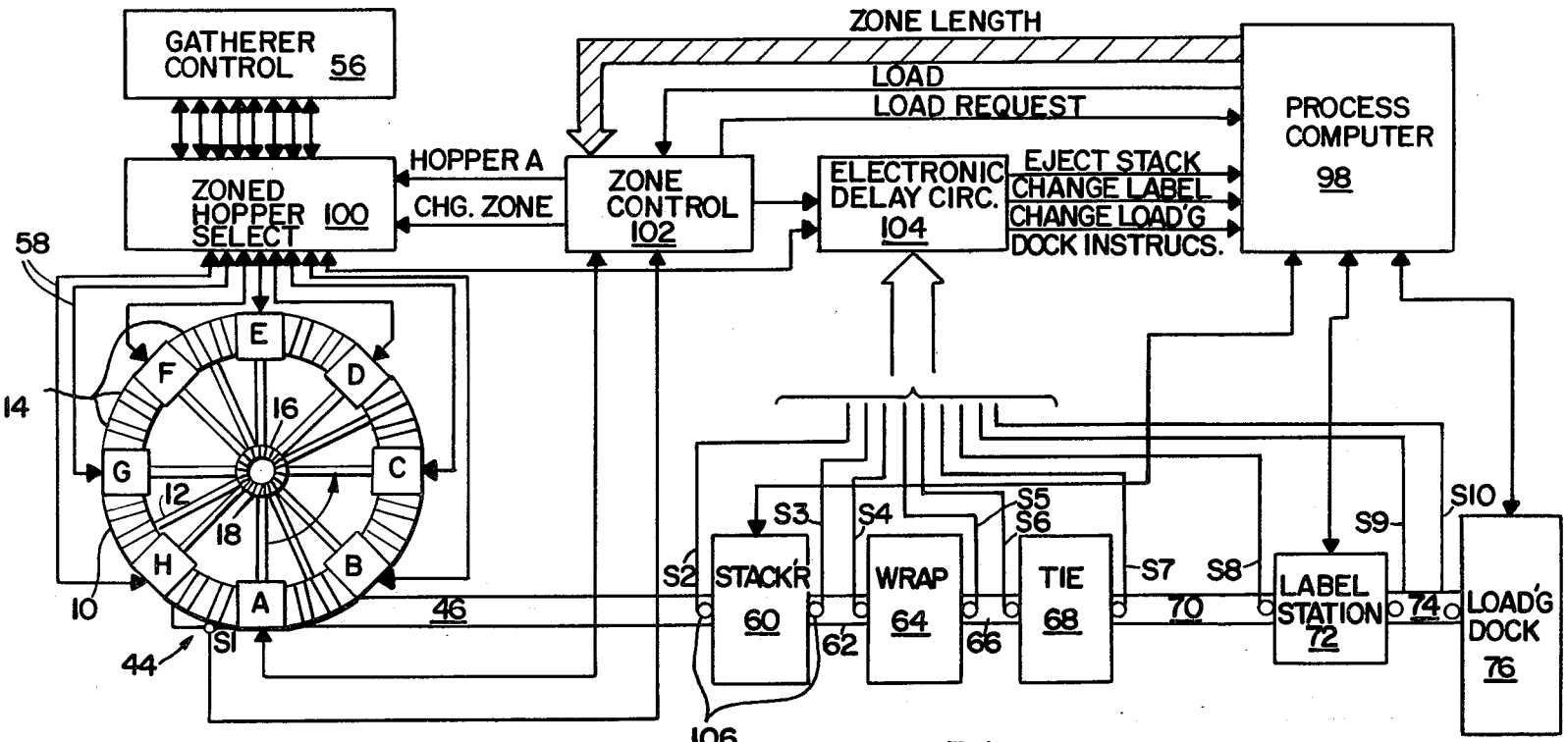
FIG. 1 is a general block diagram of a collating system in accordance with the present invention.

Referring now to the drawings and more particularly to FIG. 1, a known newspaper collator, i.e., a stuffing machine of the general type shown in U.S. Pat. Nos. 2,911,213 and 3,825,246, the disclosures of which are incorporated herein by reference, is illustrated in simplified form. The machine comprises a rotary turret, generally designated by reference numeral 10, including a framework 12 which supports a series of circumferentially arranged V-shaped pockets 14 which each constitute a gathering location. Turret 10 includes a central hub 16 which is rotatable about the axis of the central post 18. A motor (not shown) serves to rotate the pockets 14 about central post 18 in a counterclockwise direction.

A plurality of conventional, stationary feeding stations A–H are supported in a conventional manner above the path of the pockets 14. Each of the feeding stations includes a conventional horizontal type hopper 20 (see FIG. 3) in which newspaper sections are stacked, and a conventional mechanism for feeding the bottom one of the newspaper sections stacked in a hopper to deliver it to the open end of a pocket 14 passing underneath. The newspaper sections in each hopper are commonly referred to as "inserts".

Figure 3:
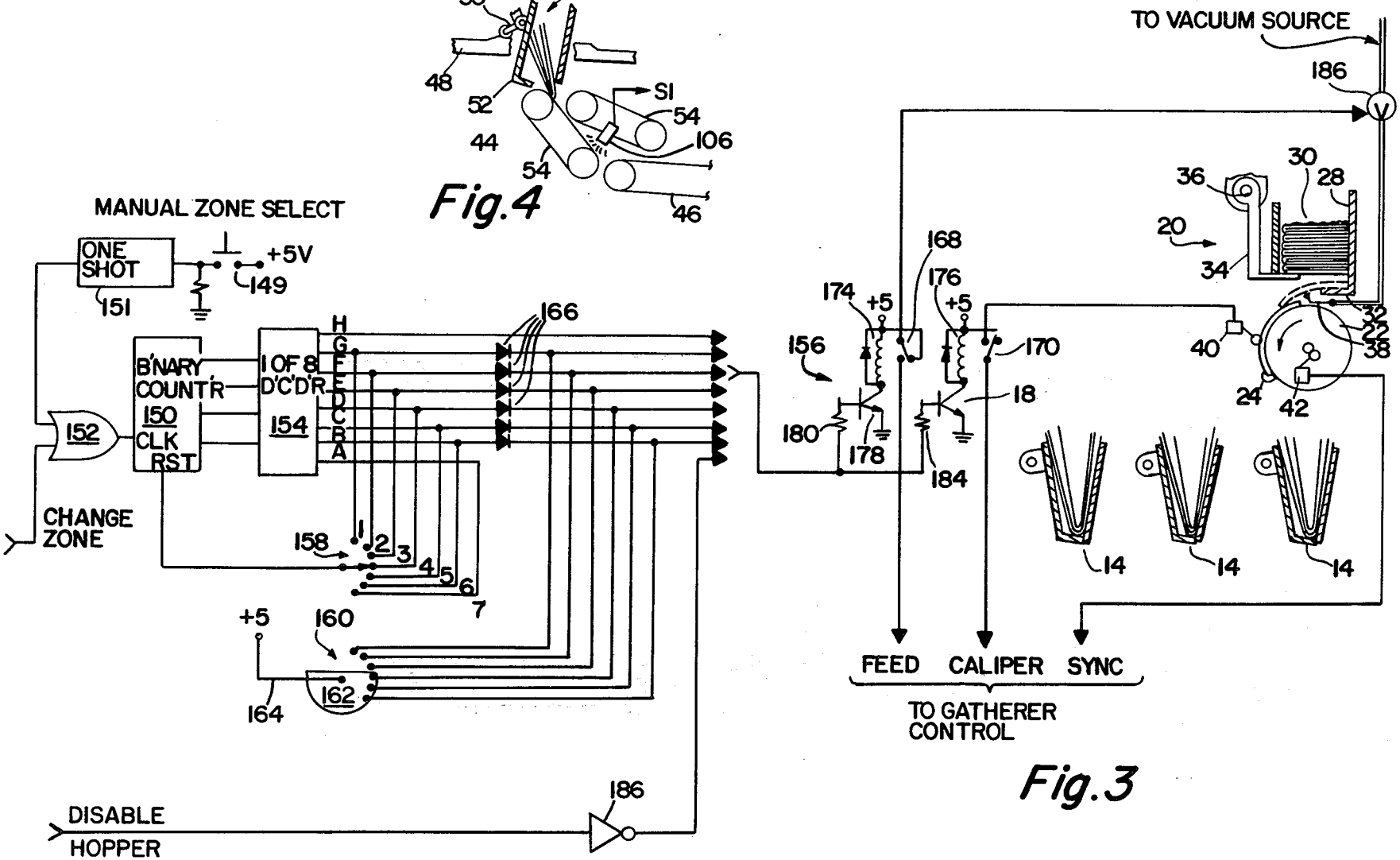
FIG. 3 is a more detailed schematic illustration of another portion of the control system broadly illustrated in FIG. 1.

As illustrated in FIG. 3, the mechanism feeding inserts at each of the feeding stations may comprise a rotatable drum 22 having a gripper finger 24 which, when actuated by a suitable mechanism (not shown), operates to grip the edge of an insert to cause it to move with the drum whereby the drum is able to pull the insert from the hopper. Drum 22 will be rotated in synchronism with the movement of the pockets.

Each hopper 20 includes a framework 28 for holding a stack of inserts 30. The bottom one of the stack of inserts is supported on a ledge 32 which is part of the framework 28, and on a movable shoe 34. The shoe 34 is fixed to a shaft 36 mounted in the framework 28 of the hopper, and is rotated outwardly to release the edge of an insert. Conventional mechanisms effects the rotation of the movable shoe 34 in synchronism with movement of the turret. When the shoe 34 is swung outward, an insert is pulled downwardly by a vacuum sucker 38 to move the insert into a position to be gripped by finger 24. As the drum rotates, finger 24 pulls the insert from the hopper. When the leading edge of the insert is in a position such that the insert will drop into the pocket 14 which is then beneath the drum, the finger 24 is opened in a conventional manner to release the insert, thus delivering the insert to the pocket. A calipering-type sheet detector 40 is positioned to sense the presence or absence of an insert at a predetermined time in the feed cycle. A switch 42 (referred to hereinafter as a sync switch) senses the position of the drum so as to signal the portion of the cycle when the insert is to be sensed by caliper 40.

Figure 4:
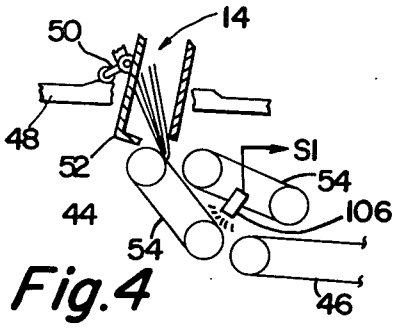
FIG. 4 is a general illustration of the delivery system shown generally in FIG. 1.

If operated as in prior systems, the pockets 14 would move in succession past each of hoppers A–H and would receive an insert from each. Upon receipt of a insert from the final hopper H, the pockets would move to a delivery station 44 located intermediate stations H and A (see FIG. 1), where they would be dropped onto a conveyor 46. The delivery station 44 is shown more particularly in FIG. 4. As each pocket 14 moves past the delivery position 44, a cam 48, which extends around the turret, normally operates a cam follower 50 associated with each pocket to move the cam follower upwardly to rotate the back wall 52 of the pocket to open the bottom of the pocket. This would allow the assembled newspapers to drop to a delivery conveyor 54. Delivery conveyor 54 will then deliver the assembled newspaper to conveyor 46, thereby forming a shingled stream of assembled newspapers along the conveyor 46.

The collating system illustrated generally in FIG. 1 will preferably include a gatherer control circuit 56 which communicates with each of the hoppers A–H by means of control lines 58. Control circuit 56 will control the collator so that a misfeed of any of the hoppers A–H will result in a repair operation. More specifically, if the sheet detector 40 at any station detects that there has been a misfeed, i.e., a failure to feed, the gatherer control 56 will prevent the hoppers downstream of that station from feeding an insert to the misfed pocket. In addition, when that pocket arrives at the position for delivering the paper to the delivery conveyors 54, the cam follower 50 will be prevented from opening the pocket. The misfed pocket will thus carry the uncompleted paper past the delivery station. When the misfed pocket arrives again at the hopper whose misfeed initiated the repair operation, feeding of inserts to that pocket will begin again. The mechanisms and control apparatus for performing this automatic repair operation are illustrated and described in the previously mentioned U.S. Pat. No. 3,825,246, and will not be described herein.

Referring now again to FIG. 1, it will be seen that the shingled stream of newspapers produced by the operation of the rotary collator will be conveyed by means of conveyor 46 through a number of downstream processing stations. The shingled stream of assembled newspapers will first arrive at a stacker 60 where the newspaper will be accumulated until a specified stack count has been reached. At this point, the stacker will eject the pile of newspapers onto a conveyor 62 for transportation to a wrap station 64. Conveyor 62 will thus convey stacks of newspapers, each having a specific stack count. Wrap station 64 applies top and bottom wraps to the stacks of newspapers produced by a stacker 60 and then delivers the wrapped stacks of newspapers onto a conveyor 66. A tie station 68 ties the stacks and delivers them onto a further conveyor 70. The stacks, thus wrapped and tied, will arrive at a label station 72 where labels are applied. A conveyor 74 then directs the completed bundles of newspaper to an automated loading dock 76 where the stacks may be automatically conveyed to an appropriate delivery truck.

The downstream processing elements (i.e., the stacker, wrap and tie stations, label station and loading dock) are all of conventional construction, and will not be described herein. These elements are, in general, controlled by a process computer 98. Process control computer 98 provides binary words to the stacker 60 which indicate the size of the stack which is to be accumulated prior to ejection. Additionally, process computer 98 will supply binary information indicating the content of the labels which are to be applied by label station 72. Label station 72 may conveniently be an on-line printing station which prints the labels as required. Finally, the process computer 98 will supply loading dock instructions to the automated loading dock 76 which will cause the bundles supplied thereto to be directed along an appropriate conveyor for delivery to a respective truck. The manner in which process computer 98 interacts with stacker 60, label station 72 and loading dock 76 is well known in the art, and is not the subject of the present invention. Consequently, these elements will not be described in detail herein.

In accordance with the present invention, additional circuitry will be added to this system which will serve to allow the geographic assembly of newspapers, and the automatic switchover of downstream equipment from one geographic zone to the next.

This apparatus includes a zoned hopper select circuit 100 (FIG. 1) which is interposed between the gatherer control lines 58 and the gatherer control circuit 56. By interrupting the control lines 58 connecting a given hopper through the zoned hopper select circuit 100 with gatherer control 56, that hopper may be disabled from supplying newspapers to the pockets 14 without interfering with the operation of the remainder of the collating system. In accordance with the present invention, two or more of hoppers A–H will be supplied with geographically related inserts. The remainder of the hoppers will include the inserts which are common to all geographic zones. Thus, for example, hoppers A–D may include standard inserts which will be included in newspaper for all zones, whereas hoppers E, F, G, and H may include geographically related inserts, only one of which should be supplied to the newspapers for any given zone. Zoned hopper select circuit 100, in response to input signals, will disable three of hoppers E, F, G and H (for example, E, F and G) while enabling the remaining hopper (H) to supply inserts. In this fashion, a newspaper including a geographically specific insert will be assembled by the collator.

A zone control circuit 102 will also be included which will monitor the operation of the collator and control the changeover from one zone to the next. When the hopper supplying the first insert (hopper A) has fed a predetermined number of inserts, corresponding to the number of newspapers which are to be assembled for a given geographic zone, zone control 102 will intiate a signal (hopper A disable) which will cause zoned hopper select circuit 100 to disable the feeding of inserts by hopper A. This signal will not, however, cause the disablement of the sheet detector associated with hopper A, however, so that this failure to feed will be interpreted as a misfeed by gatherer control circuit 56. Consequently, because of the repair feature previously described, gatherer control circuit 56 will prevent hoppers B, C, D etc. from feeding to this and succeeding pockets. Zone control 102 also counts the newspapers delivered from the collator to the conveyor and generates a change-zone signal which is supplied to zoned hopper select circuit 100. This will cause the circuit 100 to disable the one of hoppers E, F, G and H which has been supplying geographically related inserts to this point (e.g. hopper H), and to enable one of the remaining three hoppers (e.g. hopper G) to feed geographic inserts. In addition, the hopper A disable signal will be removed so that hopper A will once again begin feeding inserts to pockets 14. Thus, newspapers will be assembled having different geographic content. Those hoppers which are not in use at a given time may be made ready for subsequent operation.

Since the collating apparatus is disabled from feeding the pockets immediately following the pocket containing the last newspaper of the preceeding zone, a gap will appear in the shingled stream of newspapers provided along conveyor 46. In accordance with the present invention, this gap is used for controlling the operation of the downstream processing equipment.

Because gatherer control 56 incorporates the automatic repair feature described previously, other gaps may appear in the shingled stream of newspapers provided along conveyor 46 which are not due to the inhibiting of the supply of inserts by zone control 102. In order to distinguish a zone separation gap from an automatic repair gap, zone control 102 provides a signal to an electronic delay circuit 104 upon the initiation of a zone separation gap along the conveyor. This signal, having the form of an electrical pulse, is delayed by delay circuit 104 by an amount selected so that the delayed pulse signal occurs coincident with the arrival of the zone separation gap at stacker 60. Generally, the electrical pulse signal may not be used by itself to control the operation of downstream equipment due to the tendency of the shingled newspaper stream to slip to some extent on the conveyor. Much of the slippage occurring between the collator and the stacker is attributable to the fact that the input opening of stacker 60 is generally several feet above the delivery point of the collator. The conveyor 46 must therefore carry the newspapers up an inclined path.

A plurality of sensors 106 are provided at various places along the downstream path of the newspapers for tracking the travel of the zone separation gap. Each of the sensors will preferably include a light source for directing a beam of light into the path of the newspapers, and a light sensor for measuring the level of reflected light. These sensors will be suspended above the path of the newspapers in any conventional manner, and will provide binary signals at the output thereof which will indicate, upon the basis of the magnitude of the reflected light, the presence or absence of a newspaper or a newspaper bundle. These sensors provide outputs which are used by electronic delay circuit 104 for correcting the time occurrence of the electric pulse signal in accordance with the actual movement of the zone separation gap. In this manner, electronic delay circuit 104 will sense the arrival of the gap at various places along the downstream path, and will then initiate appropriate actions. The stacker 60 will generate bundles of newspapers continuously in any given zone. When a new zone arrives, it will be necessary to cause stacker 60 to eject any uncompleted bundle of the previous zone. Upon the arrival of the gap at stacker 60, delay circuit 104 will supply an EJECT-STACK signal to process computer 98 which will, in turn, cause it to generate a signal to cause stacker 60 to eject the bundle contained therein. Similarly, electronic delay circuit 104 will cause process computer 98 to load new label information into label station 72, upon the arrival of the zone separation gap thereat. Electronic gap circuit 104 also provides a signal to process computer 98 coincident with the arrival of the gap at loading dock 76 to cause process computer 98 to direct the manner in which the bundles are handled at the loading dock.

Since wrap station 64 and tie station 68 do not embody operations which will change from one gap to the next, these downstream operations need not be controlled in accordance with changing zones.

The three signals which are supplied by electronic gap circuit 104 to process computer 98 may take the form of priority interrupts which trigger process computer 98 to "call" specific programs stored therein. Thus, the "eject stack" signal may cause process computer 98 to download a minimum stack size of zero to stacker 60. The stacker will then immediately eject the pile of newspapers contained therein, since the number of newspapers in the stacker will exceed the newly loaded stack size.

It will be appreciated that this could also be accomplished without use of process computer 98. For example, a multiplexer could be provided having two binary word inputs, with an output directed to the stack size input to stacker 60. One of the inputs to the multiplexer would be derived from a hardwired stack size command, whereas the second input would be all zeros. Normally, the multiplexer would connect the stack size input of the stacker to the hardwired stack size command. The eject stack signal supplied by electronic delay circuit 104, however, would cause the multiplexing circuit to disconnect the stacker input from the hardwired stack size command, and to instead insert all zeros into the stacker. Similarly, the other two signals supplied by the electronic delay circuit could produce appropriate downstream change of operation without use of process computer 98.

Upon the initiation of the new zone, zone control 102 will indicate to process computer 98 that a new zone length signal must be supplied thereto. Process computer 98 will respond to the "load request" by providing a new zone length word to zone control 102, together with an appropriate load command. This, also, could be accomplished without use of the process computer. Thus, the load request line may be connected to a light on an operator's console which would inform the operator that a new zone length must be loaded therein. The operator would then set a sequence of thumbwheel switches to the appropriate zone length, and would push a load command button to load the number contained on the thumbwheel switches into zone control 102.

Figure 2:
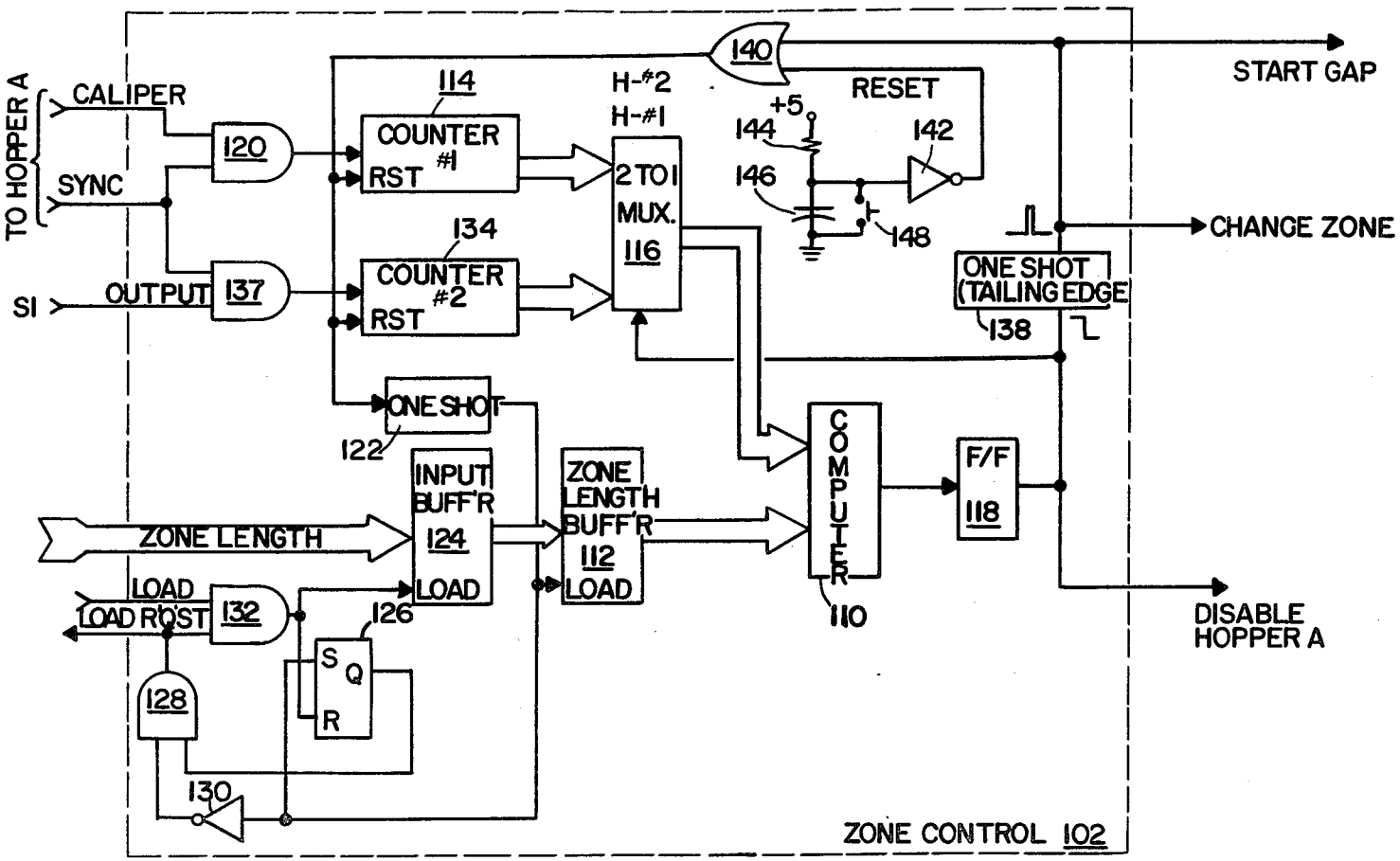
FIG. 2 is a more detailed schematic illustration of a portion of the control system broadly illustrated in FIG. 1.

There is illustrated in FIG. 2 a more detailed schematic illustration of the contents of the zone control circuit 102 of FIG. 1. The circuit comprises a comparator 110 which serves to compare the desired length of the zone, as stored in a zone length buffer 112 with the actual number of newspapers assembled by the collator, as indicated by the contents of a counter 114. The output of counter 114 is directed to comparator 110 by means of a two-to-one multiplexer 116. Multiplexer 116 is controlled by the output of a flip flop 118 which controls the disablement of hopper A at the conclusion of a given zone. If the output of flip flop 118 is at a low logic level (i.e. binary "0"), then hopper A is enabled and the collator is assembling newspapers. This low logic level output also causes two-to-one multiplexer 116 to connect the comparator input to the output of counter 114.

Counter 114 is incremented by one count each time hopper A delivers an insert to a pocket. This pulse is produced by ANDing together the outputs of the sync switch 42 with the sheet detector (caliper 40) of hopper A. Thus, when the output of caliper A is at a high logic level (i.e. binary "1"), indicating that an insert is present on the drum 22 (FIG. 3) at the appropriate time interval (signaled by sync switch 42), then the output of an AND gate 120 will go to a high logic level, producing an incrementing of counter 114. Counter 114, which was reset at the beginning of a given zone in a manner which will be made clear hereinafter, will thus contain a count indicating the number of newspaper inserts which have been properly fed by hopper A. Misfeeds of hopper A will not be included within this count since the output of AND gate 120 will only go high when the caliber signal indicates that an insert has been properly withdrawn from the hopper.

As stated previously, zone length buffer 112 will store a binary word indicating the desired length of the present zone. This zone length buffer will be reloaded with a new zone length at the beginning of each new zone, by a one shot 122. The manner in which 122 is triggered to produce the pulse which loads zone length buffer 112 will be made clear hereinafter. Upon the occurrence of a pulse at the load input of zone length buffer 112, the buffer will store the binary number being supplied thereto by an input buffer 124 and will provide this number to comparator 110. This same pulse which loads zone length buffer 112 also sets a set-reset flip flop 126. The Q output of flip flop 126 serves as a "load request" flag, indicating to the rest of the system that a new zone length has been loaded into zone length buffer 112 and that the input buffer must now be loaded with a new zone length. The flag is ANDed through an AND gate 128 so that the load request flag is not raised until after the load signal is removed from zone length buffer 112. This is accomplished by inverting the load signal supplied by one shot 122 through an inverter 130, and then ANDing the resulting signal with the output of flip flop 126. The output of AND gate 128 will thus only reflect the output of flip flop 126 after the load pulse has elapsed. The "load request" signal is also directed to another AND gate 132 where it is ANDed with the incoming load command supplied by process computer 98 of FIG. 1. AND gate 132 is included to insure that input buffer 124 is only loaded when a "load request" has been generated. Process computer 98 will then provide a new zone length at the input to input buffer 124 and will provide a high logic level pulse to the input to AND gate 132. Since the load request line will, at that time, be at a high logic level, this load pulse will be supplied to input buffer 124, and to the reset line of flip flop 126. This will thus cause input buffer 124 to load the new zone length, and will remove the load request by resetting flip flop 126.

Comparator 110 will compare the contents of the zone length buffer 112 with the output of counter 114 and will provide a high logic level signal when the two are equal. This will cause flip flop 118 to toggle from a low logic level to a high logic level. The high logic output of flip flop 118 will cause the disablement of hopper A, thus preventing further newspapers from being assembled by the collator. Additionally, this high output signal will cause two-to-one multiplexer 116 to disconnect counter 114 from comparator 110 and instead connect the output of a second counter 134 to the input of comparator 110.

Counter 134 will contain a count corresponding to the number of assembled newspapers which have been delivered by the collator onto the conveyor 46. A reflective light sensor 136 (see FIG. 4), similar to sensors 106, will be disposed along the delivery conveyor 54 so as to sense the passage of a newspaper thereby. The output of sensor 136 will be ANDed by AND gate 137 with the sync signal provided by hopper A so that the output of sensor 136 will be "sampled" by the sync signal at the appropriate time. The placement of sensor 136 will be selected so that a newspaper should be present at that location upon the occurrence of the sync signal provided by sync switch 42 of hopper A. Since counter 134 was also reset at the initiation of a new zone, this counter will contain a count indicating the number of papers which have been delivered by the collator in a given zone. Since all of the newspapers which were begun at hopper A will eventually be delivered onto conveyor 46, the count contained within counter 134 will eventually be equal to the count contained within counter 114. Thus, the count contained within counter 134 will eventually reach the number indicated in zone length buffer 112. The output of comparator 110 will then again go to a high logic level, causing flip flop 118 to toggle to the opposite state (i.e. back to a low logic level). This will, of course, occur when the final paper in the zone is delivered by the collator to the conveyor.

This shift in the output of flip flop 118 will result in the enablement of hopper A, which will again feed the inserts into the pockets 14 passing therebeneath. Additionally, this will trigger a falling-edge triggered one-shot 138 to produce a pulse at the output thereof. This pulse will indicate to the zoned hopper select circuit 100 (FIG. 1) that a change in zone is to occur, and will also indicate to the electronic delay circuit 104 that the gap has started at the output of collator 10. Furthermore, the output of one shot 138 will be directed through an OR gate 140 and will produce the resetting of the zone control circuit. Thus, the pulse provided by OR gate 140 will directly reset counters 114 and 134 and will indirectly reload the zone length buffer 112 by means of a one shot 122, in the manner previously described.

It will be noted that OR gate 140 includes a second input for resetting the zone control circuit under other conditions. The zone control circuit is automatically reset upon the application of power to the circuit in the first instance by connecting the input to an inverter 142 to the junction between a series combination of a resistor 144 and a capacitor 146, which are together connected across the power supply. When power is initially applied to the circuit, the capacitor 146 will have developed no voltage thereacross, and thus the input to inverter 142 will be at a low logic level. This will cause a high signal to be provided by inverter 142 to OR gate 140, which will produce the resetting of the zone control circuit. Shortly after power is initially applied to the circuit, the capacitor 146 will have charged to a high logic level through a resistor 144, and thus the output of inverter 142 will drop to a low logic level, removing the reset pulse. In addition, a switch 148 may be connected across a capacitor 146 for allowing the control circuit to be manually reset. When this button is pushed, the charge across capacitor 146 will be drained to ground and a reset pulse will again be provided by inverter 142.

Illustrated in FIG. 3 is a more detailed showing of the zoned hopper select circuit, circuit 100 (FIG. 1), which may be used in practicing the invention. As illustrated therein, the circuit includes a binary counter 150 which is incremented by each of the change of zone pulses provided by one shot 138 (FIG. 2) via OR gate 152. The zoned hopper may also be manually changed by depressing a button 149 associated with a one-shot 151. When button 149 is depressed, one-shot 151 will generate a high logic level pulse which will increment binary counter 150 in the same manner as the change of zone pulses provided by the zone control circuit. The count contained within binary counter 150 indicates the one of hoppers A–H which is to be enabled to supply geographic inserts. The output of binary counter 150 is decoded by a one-of-eight decoder 154.

One-of-eight decoder 154 responds to the count contained within binary counter 150 to provide a high logic level signal on one of its eight outputs. When binary counter 150 contains a count of 0, then output H of decoder 154 will be at a high logic level, with the remaining outputs having a low logic level signal thereon. A "1" count contained within binary counter 150 will, on the other hand produce a high logic level signal on the G output of one of eight decoder 154, with the H output and other outputs being at a low logic level. With each incrementing of binary counter 150, decoder 154 steps to the next lower output and provides a high logic level output thereon, with the remaining outputs having a low logic level signal.

A rotary switch 158 is included for selecting the hoppers which are to be operated with geographic inserts therein. With the switch in position "4", as illustrated, the last four hoppers (H, G, F, E) will be enabled in sequence to feed geographic inserts while the first four hoppers (D,C,B,A) will be enabled for all zones, and will supply inserts common to all zones. As stated previously, switch 149 may be used by the operator to select the one of the zoned hoppers (H,G,F,E) which is to be initially used. This switch serves to connect one of the outputs of decoder 154 to the reset line of binary counter 150. In the illustrated position, switch 158 serves to actuate the reset line of binary counter 150 with the D output of one-of-eight decoder 154. In this position, the decoder will provide a high logic level sequentially on the H, G, F and E outputs in response to consecutive change of zone pulses from one shot 138 (FIG. 2). When the E output of decoder 154 is at a high logic level, however, the next pulse provided to the clock input of binary color 150 will cause the D output of one of eight decoder to go to a high logic level, thus automatically producing a reset signal which will reset binary counter 150 to 0. This will cause the H output of decoder 154 to go high, rather than the D output. Thus, the D output will only be high for the brief period of time necessary to reset binary counter 150. Each of the outputs of decoder 154 controls the enablement of a corresponding hopper. When binary counter 150 is at a 0 level, the H output of decoder 154 will be the high logic level, thus enabling the H hopper to feed inserts. The G, F and E inputs will be at low logic levels, however, thus causing the disablement of hoppers G, F and E.

Hoppers A, B, C, and D will be enabled, even though the corresponding outputs of decoder 154 are at a low logic level, due to the operation of a second rotary switch 160. Rotary switch 160 may be thought of as selecting the number of hoppers having standard inserts. Rotary switch 160 includes a conductive plate 162 which is connected to a +5 volt supply via a line 164. This plate will be rotatable past the contacts of the rotary switch and will serve to connect the contacts to the +5 volt supply. In the position shown, contacts 7, 6, 5 and 4 of rotary switch 160 are coupled to the supply. Contacts 1, 2 and 3, on the other hand, are left "floating" (i.e. unconnected). Since contacts 4, 5 and 6 of rotary switch 160 are connected to the plus five volt supply, the corresponding hopper select lines will also be at a high logic level. A plurality of diodes 166 are included to prevent the feedback of these high logic level signals to the outputs of decoder 154. The plate 162 associated with rotary switch 160 will generally be positioned by the operator in such a manner that all of the hopper select lines up to and including the line which is selected for resetting the binary counter will be at a high logic level. Thus, in the position shown, hopper select lines H, G, F and E are controlled through the operation of binary counter 150 and decoder 154, whereas hopper select lines A, B, C and D are continually at a high logic level due to switch 160.

Thus, it can be seen that the number of hoppers for supplying standard insert (as selected by switch 160)

may be selected independently of the number of hoppers for supplying geographic inserts (as selected by switch 158).

Each of the hopper select lines is directed to a hopper enable circuit 156 which serves to selectively enable or disable a corresponding hopper. For simplicity, only one of these circuits is illustrated. The enable/disable function is accomplished by interposing relay contacts 168 and 170 in the paths of the feed and caliper outputs of the corresponding hopper. Relay coils 174 and 176 are respectively associated with contacts 168 and 170 and will be energized when the hopper select line for that hopper goes to a high logic level. Thus, relay coil 174 will be energized when a transistor 178 receives base current through a resistor 180 with is fed by the hopper select line. Similarly, relay coil 176 will be energized when a transistor 182 receives base current through the resistor 184 which is also coupled to the same hopper select line.

Contacts 168 are interposed in the feed line which controls the feeding of inserts from the hopper. This feed line controls the operation of a valve 186 which is interposed between the vacuum source (not shown) in the vacuum feeder. When the feed line is at a high logic level, the valve will be actuated and the vacuum source will be shut off from the vacuum feeder. Consequently, no inserts will then be fed by the hopper. Contacts 170, on the other hand, are interposed in the line derived from the caliper switch 40 and are interposed between the output of caliper switch 40 and the gatherer control 56 (FIG. 1).

When the hopper select line is at a high logic level, then transistors 178 and 182 cause the energization of the corresponding relay coils 174 and 176, which causes contacts 168 and 170 to close. This will then connect the feed line for valve 186 and the output of caliper switch 40 to the corresponding lines of the gatherer control circuit. The hopper will thus operate or not operate in accordance with the instructions provided by the gatherer control circuit. If the hopper select line is at a low logic level, however, then relay coils 174 and 176 will be deenergized, and contacts 168 and 170 will instead be in the position shown. In this position, the feed line for controlling valve 186 will be continually connected to a +5 volt supply by means of contact 168, and thus will continually disable the supply of vacuum to vacuum feeder 38. Additionally, contacts 170 will disconnect the caliper 40 from the caliper line to gatherer control 56, thereby preventing the gatherer from recognizing that a failure to feed has occurred. Instead, the caliper line will be connected to a +5 volt supply, thereby continually indicating to the gatherer control that the hopper is feeding properly.

In summary then, when the hopper select line is at a high logic level, the contacts 168 and 170 will be closed and the hopper will operate normally. When the hopper select line is at a low logic level, however, contacts 168 and 170 will instead be in the position shown, whereby the hopper is disabled in the gatherer control is prevented from learning of this disablement.

Hopper A is not controlled by the circuitry which has thus far been described, but is rather controlled by the hopper A disable line derived from flip/flop 118 (FIG. 2) of zone control circuit 102. An inverter 186 is included so that hopper A will be disabled when the hopper A disable signal is at a high logic level. The output of inverter 186 controls the hopper disable circuitry associated with hopper A. Hopper A will include a feed disable circuit similar to that shown in FIG. 3, but will not include the caliper disable circuitry also shown in FIG. 3. Consequently, when the output of flip/flop 118 of FIG. 2 shifts to a high logic level indicating that a zone has been completed, the output of inverter 186 (FIG. 3) will shift to a low logic level, causing the feed disable circuitry associated with hopper A to prevent hopper A from feeding further inserts. Since the caliper 40 associated with hopper A is still connected to the gatherer control, however, gatherer control 56 will interpret this failure to feed as a misfeed, and will sequentially inhibit the remaining hoppers from feeding to the hoppers which hopper A had failed to feed. Similarly, when the disabled hopper line derived from flip/flop 118 shifts back to a low logic level, indicating that feeding may once again begin, the output of inverter 186 will shift to a high logic level which will reconnect the feed line with the valve 186 associated with hopper A. Hopper A will then respond to the feed command supplied by gatherer control 56, and will feed normally.

Figure 5:
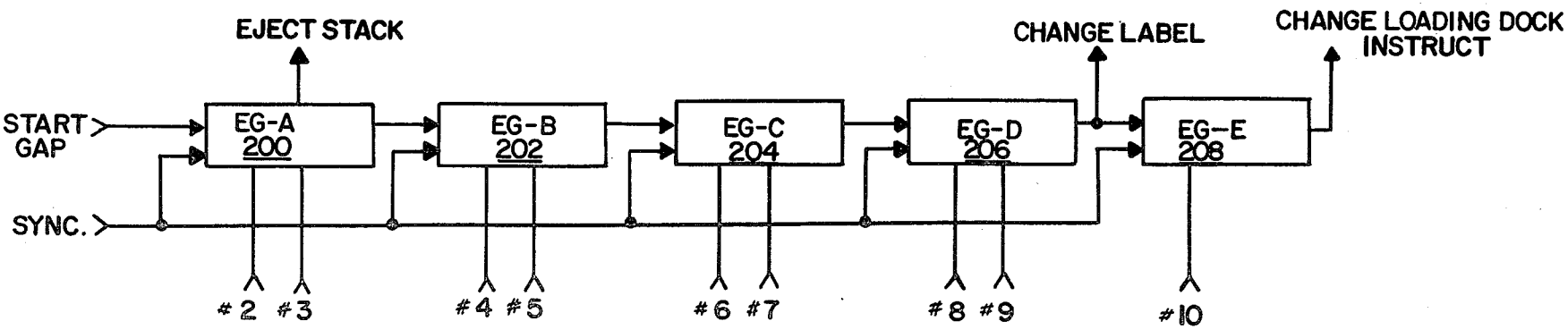
FIG. 5 is a block diagram of yet another portion of the electronic control circuit illustrated generally in FIG 1.

Referring now to FIG. 5, there is illustrated a more detailed block diagram of electronic delay circuit 104. In the embodiment illustrated in FIG. 5, electronic delay circuit 104 is illustrated as including five delay circuits 200–208, each of which is activated by the operation of the preceeding delay circuit. Each delay circuit has several of sensors 106 (FIG. 1) associated therewith. The sensors track the movement of the gap through the downstream processing equipment, and permit the delay circuits to readjust the timing of the delays in accordance with the actual movement of the gap. These delay circuits provide the signals illustrated in FIG. 1 as being derived by electronic delay circuit 104. Thus, delay circuit 200 generates the eject stack signal, while delay circuit 206 provides the change-of-label signal, and delay circuit 208 provides the signal which produces the change in the loading dock operation.

Figure 6:
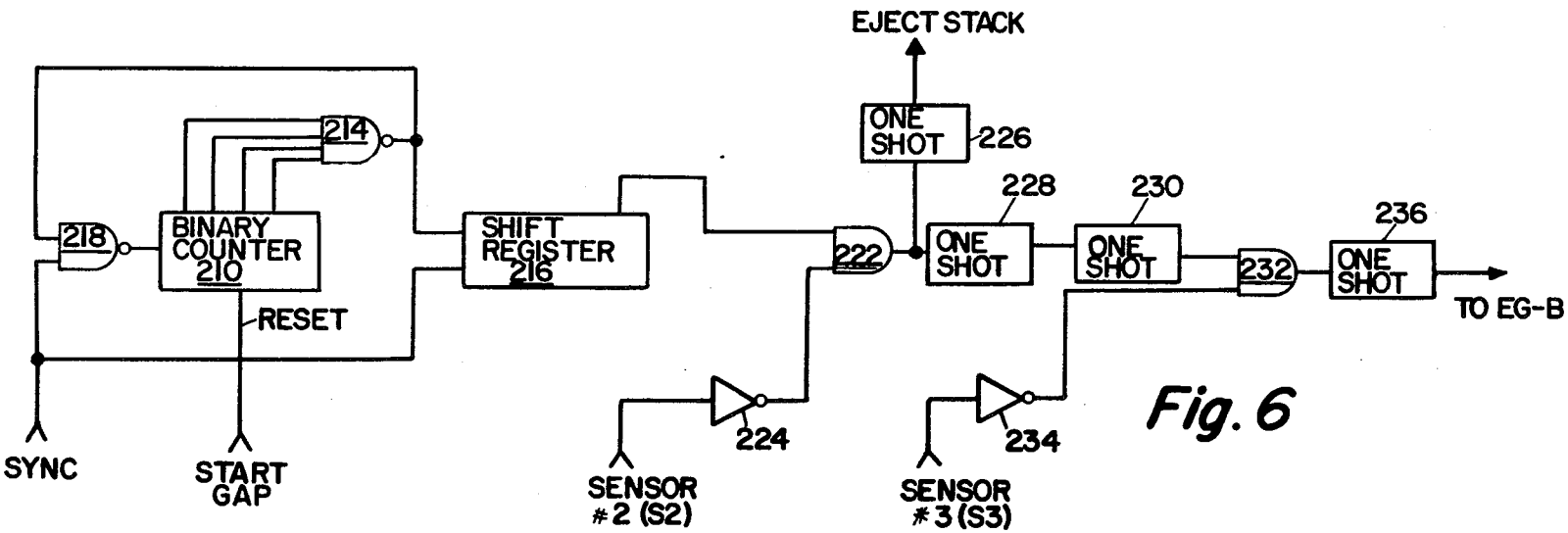
FIG. 6 is a detailed schematic illustration of one of the blocks of the circuit illustrated in FIG. 5.

Delay circuit 200 may take the form illustrated more specifically in FIG. 6. Upon the initiation of a gap, as indicated by the start gap signal provided by one shot 138 (FIG. 2), a binary counter 210 will be reset to a 0 value. This counter is included so as to insert an identifiable signal (e.g., binary "1"s) in a predetermined number of shift positions of a shift register 216. This signal will represent the electrical counterpart of the physical gap, and will move along the shift register in synchronism with the movement of the physical gap. This will be brought out more clearly hereinafter. Since, when reset, all of the output 212 of binary counter 210 will be at a 0 value, the output of a NAND gate 214, which has for its input the outputs of binary counter 210, will be at a high logic level. The output of the NAND gate 214 is directed to shift register 216 for inserting the electrical gap signal therein, and into one of the two inputs of an AND gate 218. AND gate 218 is used for controlling the supply of clock pulses to binary counter 210. When AND gate 218 is enabled by the high logic level signal appearing at the output of the NAND gate 214, the sync pulses derived from hopper A will be enabled to pass to the clock input of binary counter 210. Thus, binary counter 210 will begin incrementing with each succeeding sync pulse provided by hopper A.

The sync pulses derived from hopper A are also utilized as a shift command for shift register 216, so that the contents of shift register 216 will be shifted by one stage for each sync pulse supplied at the sync input thereto. Since the serial input of shift register 216 is connected to the output of NAND gate 214, the first 16 shift positions of shift register 216 will be loaded with binary ones. The number of shift positions (i.e., 16) occupied by the electrical gap signal is arbitrary, and may be any convenient number. After 16 sync pulses, however, all of the outputs of binary counter 210 will be at a high logic level, causing the output of NAND gate 214 to shift to a low logic level. This will result in the disablement of AND gate 218 and the prevention of binary counter from further incrementing. Consequently, the binary counter will remain in this state until reset by the next succeeding start-gap signal. Since the output of NAND gate 214 is now at a low logic level, each succeeding sync pulse will result in the entry of a low logic level signal into shift register 216. Shift register 216 will have multiple shifting stages therein, the number of which will be selected to correspond to the number of newspaper positions between the sensor 44 and the sensor 106 at the input stacker 60 (FIG. 1).

A tap 218 will be taken at the stage corresponding to the number of newspaper positions between the two sensors. Consequently, the ones which were entered into shift register 216 by NAND gate 214 should arrive at tap 218 in synchronism with the arrival of the gap at sensor 106. The output of the shift register 216 will remain continuously at a high logic level for 16 sync pulses thereafter since 16 shift positions of shift register 216 were loaded with logic "ones". The output of the shift register is directed to an AND gate 222 which is provided for sensing the conjunction of the electronic gap with the arrival of the physical gap at the sensor 106 located at the input of stacker 60. An inverter 224 is provided for inverting this sensor output signal so that it will have the proper logic sense. The output of inverter 224 will shift to a high logic level when a gap is present in the shingled stream of newspapers, and will otherwise be at a low logic level. When the output of inverter 224 is at a high logic level, indicating that gap has been sensed by the sensor, and the output of flip flop 220 indicates that a zone separation gap should be present at that point, then the output of NAND gate 222 will shift from a high logic level to a low logic level.

This falling-edge at the output of the NAND gate 222 will trigger one-shots 226 and 228. One-shot 226 generates the eject-stack signal which was described earlier with reference to FIG. 1. It will be appreciated that this signal will only be generated upon the arrival of the actual physical gap produced by a change of zone at the input to stacker 60. One-shot 228 has a time delay which is selected to correspond with the time necessary for stacker 60 to eject the stack of newspapers. Consequently, the output of one shot 228 should shift from a high logic level to a low logic level at approximately the time that the last bundle of the preceding zone leaves stacker 60. This falling-edge on the output of one shot 228 will trigger yet another one shot 230 which will produce a pulse corresponding with beginning of the gap at the output of stacker 60. A NAND gate 232 is provided for sensing the concurrence of the delayed signal provided by one shot 230 with the existence of the actual gap at the output of stacker 60, as determined by another sensor, whose output is inverted by another inverter 234. When the NAND gate 232 senses a conjunction of these two events, the output thereof will shift from a high logic level to a low logic level, causing a one shot 236 to produce a brief pulse. This pulse serves to initiate the delay signal generated by the next delay circuit (202).

Delay circuits 202, 204, 206, and 208 will include circuitry substantially similar to the circuitry of delay circuitry 200 as shown in FIG. 6. These delay circuits will not, however, include a one-shot corresponding to one-shot 226, since the signals which must be generated by the remaining delay circuits should be issued when the stack leaves the corresponding station, rather than when it arrives at the station, as was the case with stacker 60.

What has thus been described is a collating system which produces newspapers assembled in accordance with geograhic considerations, and which automatically switches over downstream equipment at the conclusion of production of newspapers for of a given geographic zone. The circuit which has been illustrated for performing this function represents only one possible embodiment of the invention, and not the only one. In the event that a process computer such as process computer 98 of FIG. 1 is included in the system, it will generally be preferable to generate the functions of zone control circuit 102, electronic gap circuit 104, and certain of the functions of zoned hopper select circuit 100 as software within process computer 98, rather than including hard-wired circuitry of the nature disclosed. This approach would have the advantage of allowing flexibility, while reducing the additional cost and complexity of the system. In the event that a computer is utilized for performing these operations, only input and output considerations need be considered. Thus, the hopper disabled circuitry (such as circuitry 156 of FIG. 3) will be included, however, the select lines will be derived from an output buffer of the computer, rather than from the circuitry illustrated in the remainder of FIG. 3.

In view of this, it will be appreciated that, although the invention has been described with respect to specific embodiments, the invention is not limited to these embodiments. Instead, a large number of alterations and rearrangements of parts as well as form will be immediately recognized by those skilled in the art, are within the scope of the invention.

What is claimed is:

1. Apparatus for collating articles and controlling the processing of articles by group comprising: collating means for assembling portions of an article into an assembled article and for delivering said assembled articles to a conveyor; processing means for processing said assembled articles, said process means being responsive to a signal for performing a predetermined function on a group of said assembled articles; a conveyor for conveying said assembled articles from said collating means to at least said processing means; disabling means operatively associated with said collating means for causing said collating means to temporarily stop delivery of further said assembled articles to said conveyor upon the delivery of all of the assembled articles of a given group of articles to said conveyor, so that said conveyor conveys said assembled articles of said group towards said processing means without receiving further assembled articles from said collating means, whereby a gap containing no assembled articles is produced on said conveyor; and means for sensing the arrival at a selected location with respect to said processing means of the gap thus produced and for then signalling said processing means to perform said predetermined function.

2. Apparatus as set forth in claim 1, wherein said sensing means comprises: indication means for providing an indication when said gap is produced through the operation of said disabling means and for delaying said indication by an amount of time selected so that a delayed indication will occur substantially coincident with the arrival of said gap at said selected location with respect to said processing means; means located substantially at said selected location for sensing the absence of assembled articles at said location and for then providing a second indication; and, means for signalling said processing means upon the conjunction of said second indication and said delayed indication.

3. Apparatus as set forth in claim 2 wherein said indication means includes means for adjusting the amount of said selected delay in accordance with the actual movement of said gap along said conveyor.

4. Apparatus as set forth in claim 3, wherein said collating means comprises a gathering machine comprising a plurality of feed stations, each including a supply of a respective section of printed matter, a plurality of gathering stations moveable along a path past each of said feed stations in sequence, said feed stations each including feed means for feeding the associated section of printed matter to said gathering stations as they move past said feed stations; and, means for delivering completed groups of sections from said gathering stations to said conveyor.

5. Apparatus as set forth in claim 4, and further comprising feed station select means for disabling the feeding of sections from selected ones of said feeding stations whereby the articles assembled by said gathering machine each comprise only a selected combination of said sections.

6. Apparatus as set forth in claim 4, wherein said disabling means comprises means for preventing said feed stations from feeding to a selected number of consecutive said gathering stations following the gathering station in which the last article of the preceding group is being assembled.

7. Apparatus as set forth in claim 4, wherein said feed stations are disposed about a closed path, said gathering stations being movable about said closed path and wherein each of said feed stations further includes means for determining when the corresponding feed means has failed to properly feed a section and for providing misfeed indications thereof, and wherein said apparatus further includes gatherer control means responsive to said misfeed indications for disabling said feed stations from feeding to a misfed gatherer station until the gatherer station has returned to the feeding station which is initially misfed.

* * * * *